US007739028B2

(12) United States Patent
Groer et al.

(10) Patent No.: US 7,739,028 B2
(45) Date of Patent: Jun. 15, 2010

(54) METHOD OF OPERATION OF INTERNAL COMBUSTION ENGINE WITH PERMANENT FAULT CODE IMPLEMENTATION

(75) Inventors: Frank S. Groer, Stuttgard (DE); Tomislav I. Golub, Birmingham, MI (US)

(73) Assignee: Detroit Diesel Corporation, Detroit, MI (US)

( * ) Notice: Subject to any disclaimer, the term of this patent is extended or adjusted under 35 U.S.C. 154(b) by 40 days.

(21) Appl. No.: 11/940,086

(22) Filed: Nov. 14, 2007

(65) Prior Publication Data

US 2008/0162026 A1 Jul. 3, 2008

Related U.S. Application Data

(60) Provisional application No. 60/877,456, filed on Dec. 28, 2006.

(51) Int. Cl.
*G06G 7/64* (2006.01)

(52) U.S. Cl. ..... 701/115; 701/102; 701/114; 702/183; 702/187

(58) Field of Classification Search ..... 701/102–104, 701/108, 111, 112, 114, 115, 29–35, 101, 701/109; 123/479, 488, 688, 690; 60/274, 60/276, 277, 285, 286; 702/182–187; 340/438, 340/439, 441

See application file for complete search history.

(56) References Cited

U.S. PATENT DOCUMENTS

| | | | | |
|---|---|---|---|---|
| 5,577,475 | A * | 11/1996 | De Backer et al. | 123/479 |
| 5,656,765 | A * | 8/1997 | Gray | 73/23.32 |
| 6,003,307 | A * | 12/1999 | Naber et al. | 60/274 |
| 6,401,700 | B2 * | 6/2002 | Balekai et al. | 123/568.12 |
| 6,721,649 | B2 * | 4/2004 | Knott et al. | 701/114 |
| 6,842,676 | B2 | 1/2005 | Rodriguez | |
| 6,954,693 | B2 * | 10/2005 | Brackney et al. | 701/109 |
| 7,010,417 | B2 * | 3/2006 | Edwards et al. | 701/110 |
| 7,117,079 | B2 | 10/2006 | Streichsbier et al. | |
| 7,130,768 | B2 | 10/2006 | Hofmeister et al. | |
| 7,158,978 | B2 | 1/2007 | Goodwin | |
| 7,228,223 | B2 * | 6/2007 | Tillmann | 701/114 |
| 7,392,129 | B2 * | 6/2008 | Hill et al. | 701/105 |
| 7,444,233 | B2 * | 10/2008 | Takatsuto et al. | 701/114 |
| 7,480,559 | B2 * | 1/2009 | Groer | 701/114 |

OTHER PUBLICATIONS

HOWTO Read Your Car's Mind, Dec. 23, 2005, pp. 1-9.*

* cited by examiner

*Primary Examiner*—Willis R. Wolfe, Jr.
*Assistant Examiner*—Johnny H Hoang
(74) *Attorney, Agent, or Firm*—Bill C. Panagos; Rader, Fishman & Grauer, PLLC

(57) ABSTRACT

The present invention is directed to a method to operate an internal combustion engine with electronic control wherein fault codes indicative of emissions levels may be stored in permanent memory.

5 Claims, 2 Drawing Sheets

METHOD OF OPERATION OF INTERNAL COMBUSTION ENGINE WITH PERMANENT FAULT CODE IMPLEMENTATION

CROSS-REFERENCE TO RELATED APPLICATIONS

This application claims the benefit and priority of U.S. Provisional Application Ser. No. 60/877,456 filed on Dec. 28, 2006 entitled "EPA2007 PERMANENT FAULT CODE IMPLEMENTATION". Said application is incorporated herein by reference in its entirety.

BACKGROUND OF THE INVENTION

1. Field of the Invention

In reconstructing engine failures, it is very advantageous to have certain fault codes stored in a section of memory that cannot be erased by any unauthorized service tool. The present invention relates to a method to permanently log emissions related faults in memory of an electronic controller of an internal combustion engine.

2. Description of the Related Art

Goodwin, U.S. Pat. No. 7,158,978 discloses a computerized record keeping system and method using a network to keep records that cannot be erased by a user thereby guaranteeing the accuracy of records kept with the system, a client computer system contacts through a computer network, and a server system which stores a client database accessible by a password. The client system can review, search and add records to the database. The client database on the server system is automatically backed up to avoid inadvertent loss of records or data. Once a record is entered into the server system through a client system, it is permanently stored in the server system as part of the client database. While a client may enter a modified record, the original record is always maintained and is displayed with the now modified record.

Streichsbier, et al., U.S. Pat. No. 7,117,079 discloses an apparatus that performs simultaneous data monitoring, logging and controlling of the state of the system. The apparatus includes at least one system sensor that provides a sensor data signal corresponding to system characteristic of which the sensor is detecting, a memory that stores data and program instructions and at least one output port that provides an output signal to the system and the microprocessor that receives the sensor data and executes the program instructions to monitor and log data corresponding to the data signal received from the system sensor and to provide system controlled data to the output port.

SUMMARY OF THE INVENTION

The present invention relates to a method to operate an internal combustion engine with electronic control and sensors for transmitting data signals indicative of operational parameters to said electronic control; said electronic control unit having memory with at least one region with Random Access Memory (RAM) only. The method comprises the steps of sensing exhaust emissions and transmitting data signals indicating of said emissions to said electronic control unit; comparing said data signals indicative of emissions levels to calibratable values resident in memory in said electronic control unit indicative of engine exhaust emission levels at various engine speed and engine torque values to determine whether a fault condition exists; logging said fault in said region of memory with RAM memory only; said region inaccessible to unauthorized access.

It is contemplated that the region of memory in the electronic control unit is accessible only to service tools with appropriate security access, such as a password. The method further includes logging access to the region of memory to identify users by time and password to determine whether authorized access resulted in changes to the stored faults.

These and other aspects of the invention will become understood and apparent upon a reading of the following specification and claims.

DETAILED DESCRIPTION OF THE PREFERRED EMBODIMENT(S)

Figure 1:
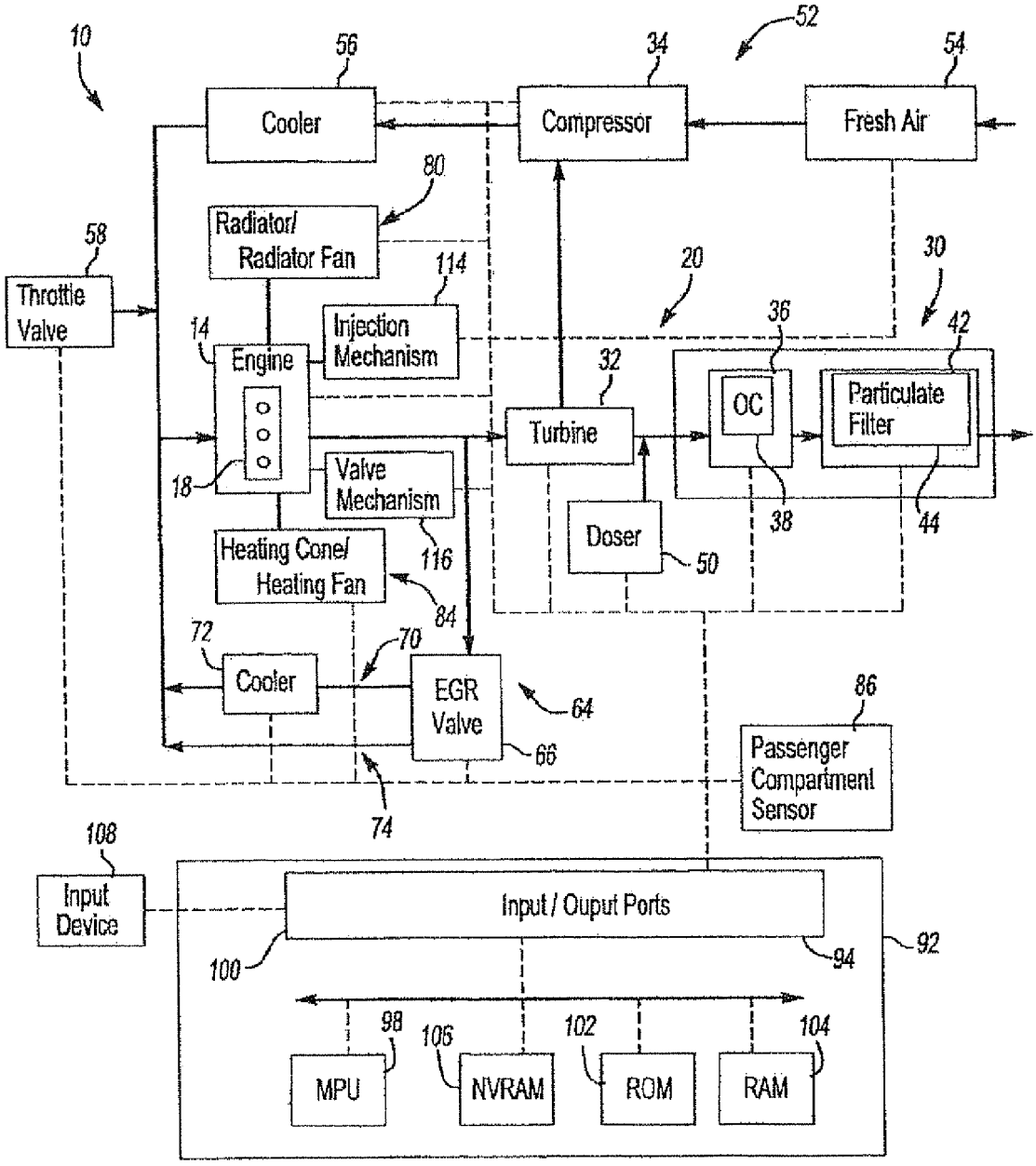
FIG. 1 is a schematic representation of an electronic controlled heavy duty diesel engine with electronic controller and service tool.

FIG. 1 illustrates a vehicle powertrain system 10 in accordance with one non-limiting aspect of the present invention. The system 10 may provide power for driving any number of vehicles, including on-highway trucks, construction equipment, marine vessels, stationary generators, automobiles, trucks, tractor-trailers, boats, recreational vehicle, light and heavy-duty work vehicles, and the like.

The system 10 may be referred to as an internal combustion driven system wherein fuels, such as gasoline and diesel fuels, are burned in a combustion process to provide power, such as with a spark or compression ignition engine 14. The engine 14 may be a diesel engine that includes a number of cylinders 18 into which fuel and air are injected for ignition as one skilled in the art will appreciate. The engine 14 may be a multi-cylinder compression ignition internal combustion engine, such as a 4, 6, 8, 12, 16, or 24 cylinder diesel engines, for example. It should be noted, however, that the present invention is not limited to a particular type of engine or fuel.

Exhaust gases generated by the engine 14 during combustion may be emitted through an exhaust system 20. The exhaust system 20 may include any number of features, including an exhaust manifold and passageways to deliver the emitted exhaust gases to a particulate filter assembly 30, which in the case of diesel engines is commonly referred to as a diesel particulate filter. Optionally, the system 20 may include a turbocharger proximate the exhaust manifold for compressing fresh air delivery into the engine 14. The turbocharger, for example, may include a turbine 32 and a compressor 34, such as a variable geometry turbocharger (VGT) and/or a turbo compound power turbine. Of course, the present invention is not limited to exhaust systems having turbochargers or the like.

The particulate filter assembly 30 may be configured to capture particulates associated with the combustion process. In more detail, the particulate filter assembly 30 may include an oxidation catalyst (OC) canister 36, which in includes an OC 38, and a particulate filter canister 42, which includes a particulate filter 44. The canisters 36, 42 may be separate components joined together with a clamp or other feature such that the canisters 36, 42 may be separated for servicing and other operations. Of course, the present invention is not intended to be limited to this exemplary configuration for the particulate filter assembly 30. Rather, the present invention contemplates the particulate filter assembly including more or less of these components and features. In particular, the present invention contemplates the particulate filter assembly 30 including only the particulate filter 44 and not necessarily the OC canister 36 or substrate 38 and that the particulate filter 44 may be located in other portions of the exhaust system 20, such as upstream of the turbine 32.

The OC 38, which for diesel engines is commonly referred to as a diesel oxidation catalyst, may oxidize hydrocarbons and carbon monoxide included within the exhaust gases so as to increase temperatures at the particulate filter 44. The particulate filter 44 may capture particulates included within the exhaust gases, such as carbon, oil particles, ash, and the like, and regenerate the captured particulates if temperatures associated therewith are sufficiently high. In accordance with one non-limiting aspect of the present invention, one object of the particulate filter assembly 30 is to capture harmful carbonaceous particles included in the exhaust gases and to store these contaminates until temperatures at the particulate filter 44 favor oxidation of the captured particulates into a gas that can be discharged to the atmosphere.

The OC and particulate filter canisters 36, 42 may include inlets and outlets having defined cross-sectional areas with expansive portions there between to store the OC 38 and particulate filter 44, respectively. However, the present invention contemplates that the canisters 36, 42 and devices therein may include any number configurations and arrangements for oxidizing emissions and capturing particulates. As such, the present invention is not intended to be limited to any particular configuration for the particulate filter assembly 30.

To facilitate oxidizing the capture particulates, a doser 50 may be included to introduce fuel to the exhaust gases such that the fuel reacts with the OC 38 and combusts to increase temperatures at the particulate filter 44, such as to facilitate regeneration. For example, one non-limiting aspect of the present invention contemplates controlling the amount of fuel injected from the doser as a function of temperatures at the particulate filter 44 and other system parameters, such as air mass flow, EGR temperatures, and the like, so as to control regeneration. However, the present invention also contemplates that fuel may be included within the exhaust gases through other measures, such as by controlling the engine 14 to emit fuel with the exhaust gases.

An air intake system 52 may be included for delivering fresh air from a fresh air inlet 54 through an air passage to an intake manifold for introduction to the engine 14. In addition, the system 52 may include an air cooler or charge air cooler 56 to cool the fresh air after it is compressed by the compressor 34. Optionally, a throttle intake valve 58 may be provided to control the flow of fresh air to the engine 14. Optionally, the throttle intake valve 58 may also be provided to control the flow of EGR gases to the engine 14 or control both fresh air and EGR gases 64 to the engine 14. The throttle valve 58 may be a manually or electrically operated valve, such as one which is responsive to a pedal position of a throttle pedal operated by a driver of the vehicle. There are many variations possible for such an air intake system and the present invention is not intended to be limited to any particular arrangement. Rather, the present invention contemplates any number of features and devices for providing fresh air to the intake manifold and cylinders, including more or less of the foregoing features.

An exhaust gas recirculation (EGR) system 64 may be optionally provided to recycle exhaust gas to the engine 14 for mixture with the fresh air. The EGR system 64 may selectively introduce a metered portion of the exhaust gasses into the engine 14. The ER system 64, for example, may dilute the incoming air charge and lower peak combustion temperatures to reduce the amount of oxides of nitrogen produced during combustion. The amount of exhaust gas to be recirculated may be controlled by controlling an EGR valve 66 and/or in combination with other features, such as the turbocharger. The EGR valve 66 may be a variable flow valve that is electronically controlled. There are many possible configurations for the controllable EGR valve 66 and embodiments of the present invention are not limited to any particular structure for the EGR valve 66.

The EGR system 64 in one non-limiting aspect of the present invention may include an EGR cooler passage 70, which includes an EGR cooler 72, and an EGR cooler bypass 74. The EGR valve 66 may be provided at the exhaust manifold to meter exhaust gas through one or both of the EGR cooler passage 70 and bypass 74. Of course, the present invention contemplates that the EGR system 64 may include more or less of these features and other features for recycling exhaust gas. Accordingly, the present invention is not intended to be limited to any one EGR system and contemplates the use of other such systems, including more or less of these features, such as an EGR system having only one of the EGR cooler passage or bypass.

A cooling system 80 may be included for cycling the engine 14 by cycling coolant there through. The coolant may be sufficient for fluidly conducting away heat generated by the engine 14, such as through a radiator. The radiator may include a number of fins through which the coolant flows to be cooled by air flow through an engine housing and/or generated by a radiator fan directed thereto as one skilled in the art will appreciated. It is contemplated, however, that the present invention may include more or less of these features in the cooling system 80 and the present invention is not intended to be limited to the exemplary cooling system described above.

The cooling system 80 may operate in conjunction with a heating system 84. The heating system 84 may include a heating core, a heating fan, and a heater valve. The heating core may receive heated coolant fluid from the engine 14 through the heater valve so that the heating fan, which may be electrically controllable by occupants in a passenger area or cab of a vehicle, may blow air warmed by the heating core to the passengers. For example, the heating fan may be controllable at various speeds to control an amount of warmed air blown past the heating core whereby the warmed air may then be distributed through a venting system to the occupants. Optionally, sensors and switches 86 may be included in the passenger area to control the heating demands of the occupants. The switches and sensors may include dial or digital switches for requesting heating and sensors for determining whether the requested heating demand was met. The present invention contemplates that more or less of these features may be included in the heating system and is not intended to be limited to the exemplary heating system described above.

A controller 92, such as an electronic control module or engine control module, may be included in the system 10 to control various operations of the engine 14 and other system or subsystems associated therewith, such as the sensors in the exhaust, EGR, and intake systems. Various sensors may be in electrical communication with the controller via input/output ports 94. The controller 92 may include a microprocessor unit (MPU) 98 in communication with various computer readable storage media via a data and control bus 100. The computer readable storage media may include any of a number of known devices which function as read only memory 102, random access memory 104, and non-volatile random access memory 106. A data, diagnostics, and programming input and output device 108 may also be selectively connected to the controller via a plug to exchange various information therebetween. The device 108 may be used to change values within the computer readable storage media, such as configuration settings, calibration variables, instructions for EGR, intake, and exhaust systems control and others.

The system 10 may include an injection mechanism 114 for controlling fuel and/or air injection for the cylinders 18. The injection mechanism 114 may be controlled by the controller 92 or other controller and comprise any number of features, including features for injecting fuel and/or air into a common-rail cylinder intake and a unit that injects fuel and/or air into each cylinder individually. For example, the injection mechanism 114 may separately and independently control the fuel and/or air injected into each cylinder such that each cylinder may be separately and independently controlled to receive varying amounts of fuel and/or air or no fuel and/or air at all. Of course, the present invention contemplates that the injection mechanism 114 may include more or less of these features and is not intended to be limited to the features described above.

The system 10 may include a valve mechanism 116 for controlling valve timing of the cylinders 18, such as to control air flow into and exhaust flow out of the cylinders 18. The valve mechanism 116 may be controlled by the controller 92 or other controller and comprise any number of features, including features for selectively and independently opening and closing cylinder intake and/or exhaust valves. For example, the valve mechanism 116 may independently control the exhaust valve timing of each cylinder such that the exhaust and/or intake valves may be independently opened and closed at controllable intervals, such as with a compression brake. Of course, the present invention contemplates that the valve mechanism may include more or less of these features and is not intended to be limited to the features described above.

In operation, the controller 92 receives signals from various engine/vehicle sensors and executes control logic embedded in hardware and/or software to control the system 10. The computer readable storage media may, for example, include instructions stored thereon that are executable by the controller 92 to perform methods of controlling all features and sub-systems in the system 10. The program instructions may be executed by the controller in the MPU 98 to control the various systems and subsystems of the engine and/or vehicle through the input/output ports 94. In general, the dashed lines shown in FIG. 1 illustrate the optional sensing and control communication between the controller and the various components in the powertrain system. Furthermore, it is appreciated that any number of sensors and features may be associated with each feature in the system for monitoring and controlling the operation thereof.

In one non-limiting aspect of the present invention, the controller 92 may be the DDEC controller available from Detroit Diesel Corporation, Detroit, Mich. Various other features of this controller are described in detail in a number of U.S. patents assigned to Detroit Diesel Corporation. Further, the controller may include any of a number of programming and processing techniques or strategies to control any feature in the system 10. Moreover, the present invention contemplates that the system may include more than one controller, such as separate controllers for controlling system or subsystems, including an exhaust system controller to control exhaust gas temperatures, mass flow rates, and other features associated therewith. In addition, these controllers may include other controllers besides the DDEC controller described above.

In accordance with one non-limiting aspect of the present invention, the controller 92 or other feature, may be configured for permanently storing emission related fault codes in memory that is not accessible to unauthorized service tools. Authorized service tools may be given access by a password and in the event access is given, a log is made of the event as well as whether any changes that are attempted to made to the stored fault codes. It is contemplated that any number of faults may be stored in permanent memory, and that preferably eight such faults are stored in memory.

Figure 2:
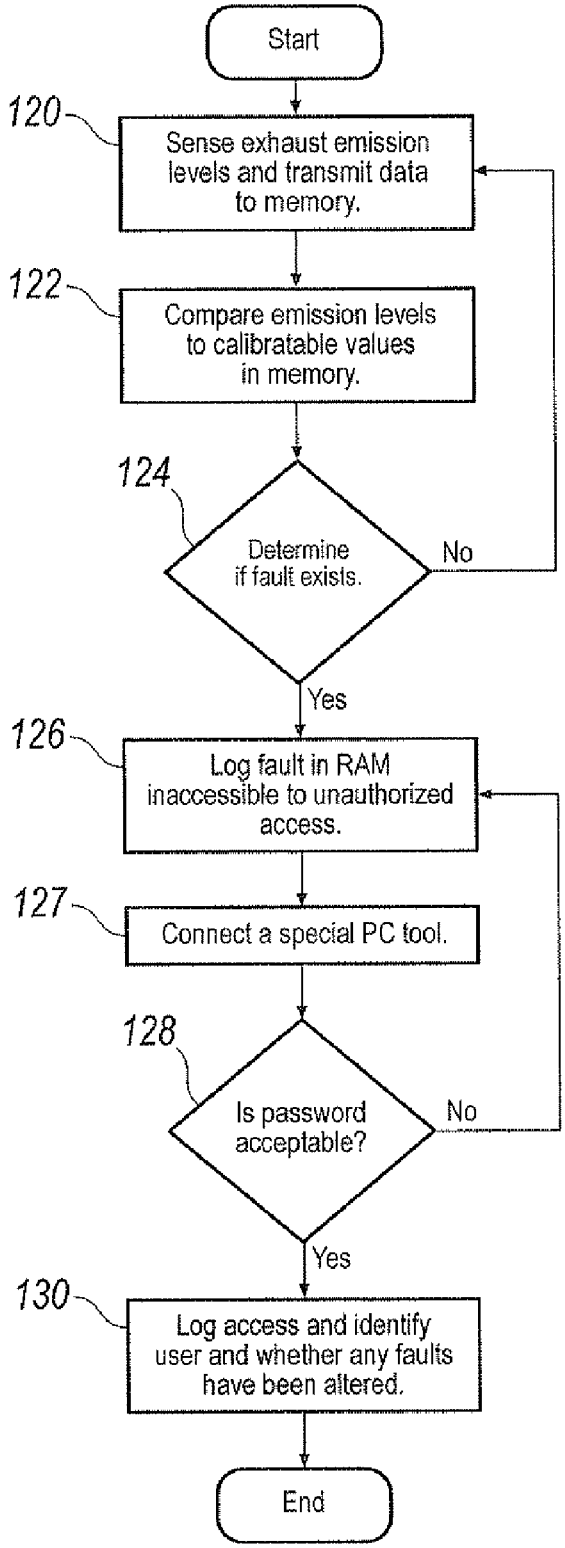
FIG. 2 is a software flowchart showing the steps of one method of the present invention.

FIG. 2 is a software flow chart showing representative steps of one method of the invention. Specifically, method 118 is a method to operate an internal combustion engine with electronic control and sensors for transmitting data signals indicative of operational parameters to said electronic control. The electronic control unit has a memory with at least one region with Random Access Memory (RAM) only. Step 120 is sensing exhaust emissions levels and transmitting data signals indicating of said emissions levels to said region of memory in said electronic control unit. Step 122 is comparing the data signals indicative of emissions levels to calibratable values resident in memory in said electronic control unit indicative of engine exhaust emission levels at various engine speed and engine torque values. Step 124 determines whether a fault condition exists. If not, step 126 is loop back to step 122. If yes, step 128 is logging said fault in said region of memory with RAM memory only. This region is inaccessible to unauthorized access. While it is stated that the memory is permanent, it is contemplated that memory is accessible to service tools with appropriate security access. An appropriate security access is a password, and once the password is accepted at step 128, a log may be made concerning the user, the time of access, and whether any of the faults within the RAM memory have been altered as at step 130. If the password is not accepting the software loop log to step 124.

It is further contemplated that in the event an electronic controller is replaced or updated, the fault codes in permanent memory shall be copied to the controller for permanent storage.

While one aspect of the invention has been described, those skilled in the art understand that the words used are words of description, and not words of limitation. Many variations and modifications are possible without departing form the scope and spirit of the invention as set forth in the appended claims.

What is claimed as new and desired to be protected by Letters Patent of the United States is:

1. A method to operate an internal combustion engine with electronic control and sensors for transmitting data signals indicative of operational parameters to said electronic control; said electronic control unit having memory with at least one region with Random Access Memory (RAM) only; said method comprising:

sensing exhaust emissions levels and transmitting data signals indicative of said emissions levels to region of memory in said electronic control unit;

comparing said data signals indicative of emissions levels to calibratable values resident in memory in said electronic control unit indicative of engine exhaust emission levels at various engine speed and engine torque values to determine whether a fault condition exists; and logging said fault in said region of memory with RAM memory only; said region inaccessible to unauthorized access.

2. The method of claim 1, wherein said memory is accessible to service tools with appropriate security access.

3. The method of claim 2, wherein said appropriate security access is a password.

4. The method of claim 3, further including logging access to the region of memory to identify users by time and password to determine whether authorized access resulted in changes to said faults.

5. The method of claim 4, wherein when said electronic controller is replaced, the fault codes in permanent memory are copied into said electronic control replacement.

* * * * *